US005788723A

United States Patent [19]

Kiss

[11] Patent Number: 5,788,723

[45] Date of Patent: Aug. 4, 1998

[54] PROCESS FOR THE HIGH-TEMPERATURE GASIFICATION OF HETEROGENEOUS WASTE

[75] Inventor: Günter H. Kiss, Minusio, Switzerland

[73] Assignee: Thermoselect AG, Germany

[21] Appl. No.: 737,995

[22] PCT Filed: Jun. 9, 1995

[86] PCT No.: PCT/DE95/00777

§ 371 Date: Feb. 13, 1997

§ 102(e) Date: Feb. 13, 1997

[87] PCT Pub. No.: WO95/34612

PCT Pub. Date: Dec. 21, 1995

[51] Int. Cl.[6] ..... C10J 3/20

[52] U.S. Cl. ..... 48/197 A; 48/197 R; 48/215

[58] Field of Search ..... 48/197 R, 215, 48/197 A

[56] References Cited

U.S. PATENT DOCUMENTS 3,920,230 11/1975 Murphy .

FOREIGN PATENT DOCUMENTS

4109063C2 12/1993 Germany .
2099841 12/1982 United Kingdom .
WO8601131 2/1986 WIPO .

*Primary Examiner*—Timothy McMahon
*Attorney, Agent, or Firm*—Howard & Howard

[57] ABSTRACT

A process for the high-temperature gasification of possibly thermally pretreated heterogeneous wastes, in which oxygen is injected into the gasification bed with the aid of water-cooled oxygen lances. The oxygen is heated by an independent pilot flame and accelerated to speeds approaching the speed of sound. Accordingly, the oxygen lances cannot be plugged by melted charge components not susceptible to gasification because the pilot flame is driven independently of the oxygen-lance flow. A pulsing, phase-shifted impact from several oxygen lances arranged in a ring produces a circulating flow of material in the gasification zone, compensating the heterogeneity of the charge in the case of a waste gasification.

5 Claims, No Drawings

PROCESS FOR THE HIGH-TEMPERATURE GASIFICATION OF HETEROGENEOUS WASTE

The invention concerns a process for the gasification of heterogeneous wastes, for example, municipal rubbish, which, possibly after a mechanical-thermal preliminary treatment, takes place with a melting of those components which cannot be gasified, the addition of oxygen to the gasification bed resulting with the aid of so-called oxygen lances.

Oxygen lances in the sense of the meaning given here are watercooled jets, with which oxygen or oxygen-enriched air is blown into the interior combustion chamber of gasification reactors.

The gasification of lignite or anthracite coal in high-temperature reactors can take place with the aid of oxygen lances with relatively little difficulty, because sufficient carbon is already present at times in the zone of flow of the lances for a gasification with introduced oxygen. It is adequate in this case to introduce the oxygen through a nozzle, possibly through multiple nozzles. The high temperatures, which in the core region of the gasifier amounts to approximately 2,000° C. or more, makes cooling, expediently water-cooling, of the lance absolutely necessary.

Also known is the complete gasification of the carbon components of domestic and industrial wastes of all types, possibly after a thermal preliminary treatment, in high-temperature reactors, and the thermal destruction of the wastes occurring in the high-temperature region of the reactor. Such a process has become known under the name "Thermoselect process" (DE 4,130,416) (F. J. Schweitzer, *Thermoselect Process for the Outgassing and Gasification of Wastes*, EF-Verlag für Energie und Umwelttechnik, 1994).

The conditions for the operation of high-temperature reactors for the gasification of wastes are essentially different than those for the gasification of coal, particularly when the wastes are to be gasified and thermally processed as unsorted mixed rubbish.

According to the respective conditions and specific type of wastes, it is not ensured, at least not with the required continuity, that adequate carbon will always be available in the reactor charge, particularly in the zone of the oxygen lance.

Disadvantages, attributable to the heterogeneity of the rubbish input as unsorted trash, can be at least compensated by a larger zone of effectiveness of the oxygen lances. By corresponding integration of the action of the flame over a larger area, it is possible to achieve a positive steadying of the gasification conditions. The greatly varying percentage mineral components in the heterogeneous wastes, which are to be melted out and cannot be gasified, requires a further adjustment of the thermal conditions with regard to the energy to be converted over the course of the process.

The known oxygen lances of conventional design to be utilized for coal gasification are only inadequately satisfactory with regard to the cited conditions for waste gasification.

For example, if the oxygen injected by the lances into the combustion chamber encounters inorganic materials there, not only will no gasification take place within the reaction chamber, but the oxygen will cool the inorganic materials, which may still have been partially molten just before that, until the inorganic materials drop below the melting temperature, disturbing the delicate equilibrium of the gasification process and preventing the discharge of meltings.

Such process disturbances could be countered by either ensuring the input of supplementary heat, as needed, into the zone of the oxygen lances, or by increasing the rate of flow of the oxygen. The effective zone in the burner segment of the reactor could be thereby increased. A combination of the measures cited above is also desirable.

It happens during the gasification of unsorted mixed rubbish with uncontrolled or unknown contents that melted droplets of metals or mineral slag—especially with the oxygen feed throttled down—plug the oxygen lances and thus render it largely ineffective.

The disadvantages of conventional oxygen lances in the gasification of wastes in high-temperature gasification reactors can be summarized as follows:

- A need-dependent introduction of heat into the reaction zone of the high-temperature reactor, in the presence of changing percentages of mineral substances which cannot be oxidized, is not possible.
- It is not possible to adjust the quantity of oxygen according to the equilibrium conditions of the gasification process.
- A heating of the oxygen, prior to injection, to increase the rate of reaction is either not possible or possible only with great risk to safety.
- An increase in the rate of flow of the oxygen is possible only with an increase in the pressure of the injected oxygen, which is expensive and risky.

The conventional lance is without effect against waste components which cannot be oxidized in advance of the lance.

The objective of the present invention is therefore to specify a process for the high-temperature gasification of heterogeneous wastes, with the melting out of metallic or mineral components, which does justice to the varying conditions of the heterogeneous charge and can be applied without risk with the use of oxygen at high temperature and a high rate of flow, in which case the processing flow of filling components which cannot be oxidized is not hindered.

This objective is achieved by the characteristics listed in claim 1. Advantageous configurations and further developments of this problem solution issue from the subclaims.

The following reciprocal effect arises from the combination of oxygen lances with the pilot flame.

The high flame temperature and high combustion rate of the pilot flame heats the lance oxygen to an extreme degree and accelerates it, at times, to supersonic speed.

The high temperature of the oxygen increases the gasification rate, and the significant acceleration of the oxygen decisively enlarges the zone subject to the effect of the lance. By this greatly enlarged effective volume of the oxygen, randomly distributed inhomogeneities in the charge are compensated, and the lance oxygen also covers gasifiable material components in all cases, even in the presence of great charge inhomogeneity.

If the pilot flame can be adjusted independently of the lance oxygen, the melting heat for inorganic mineral components and metals can be additionally fed into the reaction zone of the high-temperature reactor and metered.

The obstruction of the lance by the "freezing-on" of melted material from the charge is reliably prevented.

A particularly favorable option for the choice of fuel for the pilot flame results when synthesis gas generated by the process itself or individual components of the same, or hydrogen is used for the purpose. Then resulting in conjunction with oxygen is an oxyhydrogen-gas flame with relatively optimal process dynamics relative to flame temperature and burning rate, particularly when stoichiometric conditions are maintained. For that case, where pure oxygen or an oxygen mixture with an oxygen component of more than 90% is utilized for the pilot flame, the input of nitrogen into the system is avoided and the formation of nitrogen oxides minimized.

The excess heat of the central pilot flame, since it is driven independently of the oxygen throughput of the lance, can be applied directly to the melting of all nonoxidizable waste components and thus contribute to the avoidance of process disturbances in the reaction zone of the gasification. If the lance oxygen is introduced in pulses, in the presence of a permanently burning pilot flame, the advantage results that the channels, which the oxygen jet can form in the gasification bed, collapse in the pauses between pulses.

"Bridge formation" in the gasification bed can in this way be avoided and new, gasifiable material being continuously prepared in the zone under the effect of the lances. The conditions of gasification can also be further improved and homogenized by arranging several lances around the gasification bed, operated with a pulsing flow of oxygen and the pulses phase-shifted in such a way that the gasification zone circulates. The circulating alternation of channel formation and channel collapse results there in a vortex-like quasi-continuous conveyance of material into the gasification zone.

I claim:

1. A process for the high-temperature gasification of possibly thermally pretreated heterogeneous wastes, in which oxygen is injected into the gasification bed with the aid of at least one water-cooled oxygen lance, including the steps of:

providing the oxygen lance with at least one permanently burning pilot having a flame temperature and a combustion rate, and selectively accellerating the oxygen through the oxygen lance until it approximates the speed of sound.

2. A process according to claim 1 including the step of adjustably driving the pilot flame independently of the oxygen through the oxygen lance with components of process-internal synthesis gas, with at least combustion air enriched with oxygen substantially in a stoichiometric ratio.

3. A process according to claim 1 including the step of utilizing the excess heat given off by the pilot flame to melt waste components which cannot be oxidized.

4. A process according to claim 1 further defined as accellerating the oxygen through the oxygen lance in pulses.

5. A process according to claim 4 further defined as alternating the pulses of several lances, arranged around the gasification bed and driven with oxygen injected in pulses, in phase-shifted sequence so that the gasification zone circulates, forming channels in the gasification material during the duration of the pulse, which collapse during the pulse pauses in such a way that a rotating conveyance of material into the gasification zone takes place.

* * * * *